United States Patent [19]

Silvestri

[11] Patent Number: 4,694,726

[45] Date of Patent: Sep. 22, 1987

[54] DRUM SKIN TIGHTENING ARRANGEMENT

[75] Inventor: Frank Silvestri, Calgary, Canada

[73] Assignee: Greg Taylor, Calgary, Canada

[21] Appl. No.: 636,219

[22] Filed: Jul. 31, 1984

[30] Foreign Application Priority Data

Aug. 19, 1983 [CA] Canada ..... 435013

[51] Int. Cl.[4] ..... G10D 13/02

[52] U.S. Cl. ..... 84/413

[58] Field of Search ..... 84/411 R, 411 A, 413, 84/419

[56] References Cited

U.S. PATENT DOCUMENTS

| | | | |
|---|---|---|---|
| 3,533,324 | 10/1970 | Price | 84/411 R |
| 3,646,843 | 3/1972 | Kregal | 84/419 |
| 4,373,419 | 2/1983 | Tuttrup | 84/411 R |

FOREIGN PATENT DOCUMENTS

| | | | |
|---|---|---|---|
| 66830 | 5/1948 | Denmark | 84/413 |
| 3239329 | 4/1984 | Fed. Rep. of Germany | 84/413 |
| 2075238 | 11/1981 | United Kingdom | 84/413 |

*Primary Examiner*—Lawrence R. Franklin

*Attorney, Agent, or Firm*—William R. Hinds

[57] ABSTRACT

A drum skin tightener includes a generally triangular bracket for mounting on the body of a drum near one end thereof, flanges on the body defining sockets for releasably and pivotally receiving lugs on the top end of a lever. A bolt extending through a slot in the conventional skin retaining rim engages a pin extending transversely of the lever in the bracket, so that rotation of the lever in the bracket either secures the drum skin on the body or permits removal thereof from the body. Such an arrangement permits replacement of a drum skin without changing the tension on the retaining rim by the bolts.

3 Claims, 3 Drawing Figures

DRUM SKIN TIGHTENING ARRANGEMENT

BACKGROUND OF THE INVENTION

This invention relates to a drum skin tightener.

A conventional drum includes a hollow cylindrical body with open ends, a plurality of brackets mounted on the side of the body, a skin covering each open end and a pair of retaining rims for holding the skins on the drum body. Each skin is produced with an attached rim. When a skin is placed over the end of the drum body the retaining rim engages the skin rim. Bolts are used to attach the retaining rim to the brackets, which are merely metal lugs with threaded holes for receiving the bolts. In order to adjust the tension on the skin the bolts are tightened or loosened. Each time a skin is replaced the tension must be adjusted, which is a tedious, time consuming operation.

Obviously a need exists for a drum skin tightener which does not require adjustment each time the skin is replaced. The object of the present invention is to meet such need by providing a relatively simple drum skin tightener, which permits easy, rapid removal and replacement of a drum skin without changing the tension on the skin.

SUMMARY OF THE INVENTION

Accordingly the present invention relates to a drum skin tightener comprising bracket means for mounting on the body of the drum near one open end thereof; lever means for pivotal connection to said bracket means and to a retaining rim on the drum whereby said lever means can be rotated between a locked position, in which the retaining rim tensions the drum skin, and a release position in which the retaining rim can be removed from the drum body to release the drum skin.

BRIEF DESCRIPTION OF THE DRAWINGS

The invention will now be described in greater detail with reference to the accompanying drawing, which illustrates a preferred embodiment of the invention and wherein.

DESCRIPTION OF THE PREFERRED EMBODIMENT(S)

Figure 2:
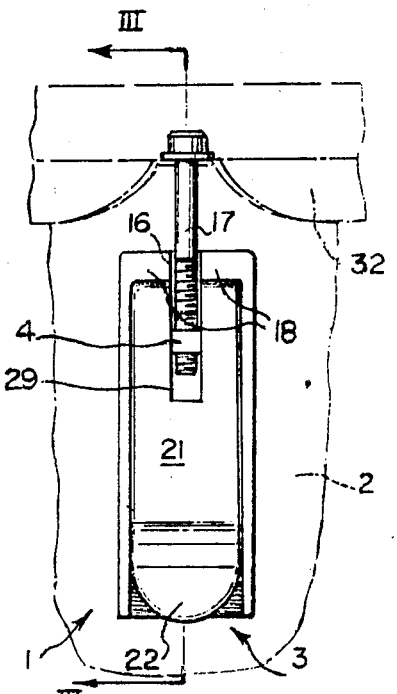
FIG. 2 is a front elevation view of the drum skin tightener of FIG. 1.

With reference to the drawing, the drum skin tightener includes a bracket generally indicated at 1 for mounting on a drum body 2, a lever generally indicated at 3 and a locking pin 4. The bracket 1 and the lever 3 are one-piece structures, preferably formed of molded plastic.

Figure 3:
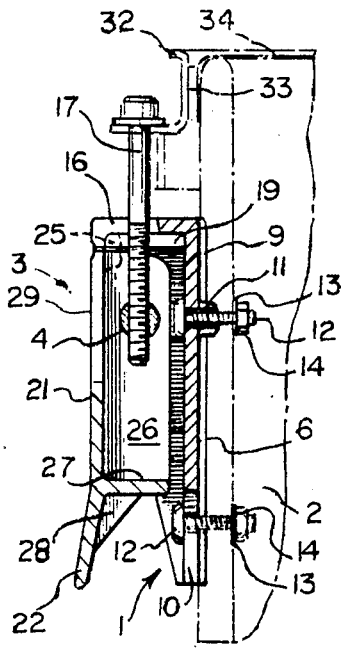
FIG. 3 is a cross section view taken generally along line III—III of FIG. 2.
Figure 1:
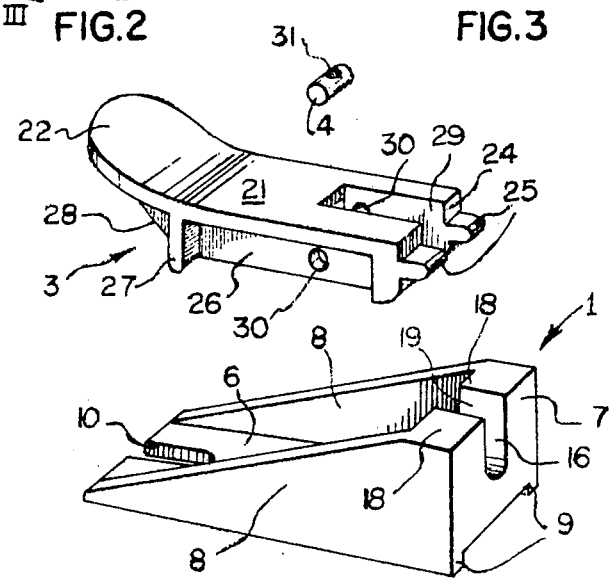
FIG. 1 is an exploded perspective view of a drum skin tightener in accordance with the present invention.

The bracket 1 is defined by base plate 6, a top end wall 7 and triangular side walls 8. The end wall 7 and the side walls 8 are integral with the base plate 6. A leg 9 extends longitudinally of the base plate 6 on each side thereof for supporting the bracket against the drum body 2. A slot 10 in the bottom end and a hole 11 (FIG. 3) near the top end of the base plate 6 receive bolts 12 for connecting the bracket 1 to the drum body 2. The bolts 12 are held in the body 2 by washers 13 and nuts 14. A U-shaped slot 16 is provided in the end wall 7 of the bracket 1 for receiving a bolt 17 as described hereinafter in greater detail. A flange 18 extends downwardly from the end wall 7 for pivotally retaining the lever 3 in the bracket 1. A second flange 19 (FIG. 3) extends from the flange 18 to the base plate 6 on each side of the slot 16.

The lever is defined by an elongated plate 21 an outwardly curving bottom end 22 which is the handle for releasing or locking the skin tightener. An end wall 24 is provided at the top end of the plate 21. A pair of lugs 25 extend upwardly from the wall 24 for pivotally connecting the lever 3 to the bracket 1. The lugs 25 fit into sockets defined by the flanges 18, between the side walls 8 and the flanges 19. A pair of ribs 26 extend longitudinally of the plate 21 between the end wall 24 and a transversely extending reinforcing rib 27. The rib 27 limits movement of the lever 3 towards the plate 6 of the bracket 1. A pair of triangular reinforcing gussets 28 aligned with the ribs 26 extend between the rib 27 and the handle 22. A slot is provided in the top end of the lever 3 which facilitates disassembly of the tightener.

The pin 4 extends between holes 30 in the ribs 26 above the centre of the lever 3. A threaded hole 31 is provided in the pin 4 for receiving the bottom end of the bolt 17. The bolt 17 extends through a slot in a retaining rim 32 on the end of the drum body 2. A plurality of bolts 17 are provided around the periphery of the drum body 2 for engaging a plurality of skin tighteners. The retaining rim 32 retains a skin rim 33 and skin 34 on the drum body 2.

In use, once the skin 34 of the drum has been properly tensioned, it is no longer necessary to make adjustments by tightening or loosening the bolts 17. In order to replace the skin 34 the handle 22 of the lever 3 is pulled upwardly and outwardly, which causes the bolt 17 to also move outwardly, releasing the retaining rim 32. The rim 32 is removed, a new skin is placed on the drum body 2 and the rim 32 is replaced. The head of the bolt 17 is placed in the usual slot in the rim 32 and the lever 3 is rotated downwardly and inwardly to lock the skin 34 on the drum body 2, under the same tension as the skin being replaced.

What I claim:

1. A drum skin tightener comprising one-piece bracket means including a base plate permitting mounting of the bracket means on the body of the drum near one open end thereof, and socket means integral with said base plate, said socket means being substantially closed but open in a direction facing away from the open drum end; lever means including lug means for releasable and pivotal insertion into said socket means, whereby said lever means can be releasably and pivotally engaged in said socket means with said bracket means; and pin means in said lever means for receiving a threaded end of a bolt to pivotally connect the lever means to a retaining rim on the drum, whereby said lever means can be rotated between a locked position in which the lug means seat firmly in said socket means and the retaining rim tensions the drum skin, and a releasable position in which the retaining rim can be removed from the drum body to release the drum skin.

2. A drum skin tightener according to claim 1, wherein said bracket means includes a top end wall and side walls integral with and projecting outwardly from said base plate, first slot means in said top end wall for receiving the bolt, and flange means integral with and extending downwardly from said top end wall to define spaced said socket means which open downwardly away from said top end wall and are separated by said slot means, said lever means including a second slot means bridged by said pin means for accomodating said bolt, said first and second slot means being aligned in the locked position of the lever means such that said threaded bolt in the locked position extends through said first and second slot means, said socket means, lug means and pin means being constructed and arranged such that in the locked position said pin means and said bolt lie relatively toward said base plate relative to the engagement of said lug means in said socket means.

3. A drum skin tightener according to claim 2 wherein said lever means includes an elongated plate defining a handle for releasing or locking the tightener, and rib means integral with said plate for receiving said pin means and for centering said lever means in said bracket means in the locked position.

* * * * *